US005400905A

United States Patent [19]

Lapalud et al.

[11] Patent Number: 5,400,905

[45] Date of Patent: Mar. 28, 1995

[54] RECEPTACLE WHICH CAN BE USED FOR DISPLAYING, DECORATING AND EVEN PROTECTING VARIOUS ARTICLES, SUCH AS POT PLANTS IN PARTICULAR

[75] Inventors: Daniel Lapalud, Amplepuis; Jean L. Paponaud, Bully, both of France

[73] Assignee: Cellocoup, France

[21] Appl. No.: 979,174

[22] Filed: Nov. 20, 1992

[30] Foreign Application Priority Data

Nov. 22, 1991 [FR] France ..... 91 14691

[51] Int. Cl.[6] ..... B65D 85/52

[52] U.S. Cl. ..... 206/423; 47/72; 47/84

[58] Field of Search ..... 47/66, 72, 84; 206/423, 206/45.33

[56] References Cited

U.S. PATENT DOCUMENTS

| | | | |
|---|---|---|---|
| 1,293,316 | 2/1919 | Bogert | 47/72 |
| 4,043,077 | 8/1977 | Stonehocker | 47/72 |
| 4,365,738 | 12/1982 | Densen | 206/45.33 |
| 4,638,595 | 1/1987 | Rivero | 47/72 |
| 4,980,209 | 12/1990 | Hill . | |
| 5,076,011 | 12/1991 | Stehouwer | 47/72 |
| 5,085,003 | 2/1992 | Garcia | 47/72 |
| 5,181,339 | 1/1993 | Weder et al. | 47/72 |

FOREIGN PATENT DOCUMENTS

| | | |
|---|---|---|
| 2397342 | 9/1979 | France . |
| 8801593 | 3/1988 | WIPO . |

*Primary Examiner*—Jimmy G. Foster
*Attorney, Agent, or Firm*—Harris Beach & Wilcox

[57] ABSTRACT

A receptacle for surrounding an article such as a pot containing a plant which is protective and decorative. A precut sheet having a central element and elongated strips radiating therefore is placed in a container having a floor and side walls. In one form of the invention, the central element is forced against the floor of the container by a retaining element which also urges the strips into an upright condition against the side walls of the container. Preferably, the strips are elevated to a height sufficient to protectively encompass the plant contained in the pot.

11 Claims, 3 Drawing Sheets

RECEPTACLE WHICH CAN BE USED FOR DISPLAYING, DECORATING AND EVEN PROTECTING VARIOUS ARTICLES, SUCH AS POT PLANTS IN PARTICULAR

BACKGROUND OF THE INVENTION

The present invention relates to an improvement made to receptacles used in numerous sectors for displaying, decorating and even protecting various products, such as pot plants in particular. In the description which follows, the invention will be described for such an application and the receptacle in accordance with the invention designated by the expression "pot cover", but it is obvious that this is not limiting and that the invention also covers all types of recipients or containers which can contain various objects, such as, for example, baskets for displaying food products (bread, fruits, etc.).

Moreover, the invention will be described for a receptacle comprising a base of circular shape, but without leaving the scope of the invention production may be envisaged of receptacles which can have a rectangular or any other shaped base, in a similar manner.

To date, in order to display, decorate and even protect pot plants, various solutions are used by florists, the more widespread solutions consisting in:

- surrounding the pot with a "sleeve" consisting of a folded tube, in particular made of paper or plastic;
- arranging the pot in a container (cover), which is flexible or rigid, possibly decorated and which has dimensions greater than those of the said pot;
- surrounding the pot with a decorated sheet, of circular shape and which, in general, has been precut.

The plant thus displayed is possibly wrapped using a plane sheet: (paper or film in particular) whose edges are securely fastened (stapling, bonding, etc.) after positioning around the article.

Although commonly used, these solutions do not, however, give complete satisfaction.

Indeed, if the articles comprising a pleated wall (and having the shape of an open tube surrounding only the periphery of the pot or possibly the shape of a cover comprising a bottom) allow a use for pots of different diameters, the presence of pleats leads to a deformation of the motifs which may be printed on the surface (decoration, text).

The covers comprising a smooth peripheral surface have, themselves, the drawback of only being able to be used for one and the same type of pot.

Moreover, all the solutions proposed to date are either not leaktight (in the case of the peripheral sleeve) or leaktight (cover surrounding the base and the lateral wall of the pot), and do not allow a choice between one or other of these possibilities, whereas it is desirable to have a perfectly leaktight receptacle during transport of the pot and it is very often desirable for the moistening water to be able to flow out when the plant is unwrapped.

Finally, apart from the receptacles of the "pleated sleeve" type which are very elastic and do not take up much storage space, the other types of pot covers, although they are stackable to a certain extent, occupy a significant volume.

Thus, there has been found, and this is the subject of the present invention, a novel type of receptacle which allows these drawbacks to be overcome, which can not only be stored flat and be formed only at the moment of its use (thus facilitating transport and storage of the empty receptacles) but may be printed on the surface with any type of motifs which are not deformed during forming of the said receptacle, and may be produced from a very wide range of raw materials, especially recycled and/or recyclable materials.

Moreover, when the receptacle in accordance with the invention is intended for pot plants, it can be used for pots having different dimensions and, in a preferential embodiment, be used either in leaktight form or non-leaktight form, at the choice of the user.

SUMMARY OF THE INVENTION

In a general manner, the receptacle in accordance with the invention is characterised in that it is produced from a plane sheet, which is transparent or coloured and possibly printed with a suitable decoration:

- the said plane sheet is in the form of a precut blank comprising a central zone whose dimensions correspond to the base of the receptacle to be produced and, extending from this central zone, radiating strips, separated from one another, whose total surface area is at least equal to the developed surface area of the volume surrounded by the said receptacle after forming;
- the said sheet is based on a substance, which is possibly recycled and/or recyclable, such as card, sheets of plastic (polyethylene, polypropylene, polyvinyl chloride, polyethylene terephthalate, etc.) or equivalent materials having a thickness and physical strength such that the lateral strips cannot deform under their own weight when they are oriented vertically or practically vertically;
- forming of the said sheet is achieved by compressing it in its central part, which brings about the lifting up of the radiating strips which come together edge to edge, with possible overlap, the folded-up strips and the flat bottom being held in this position.

When the receptacle in accordance with the invention is intended to constitute a pot cover, the central zone of the precut blank will preferably be of circular shape.

For such an application, according to an embodiment in accordance with the invention, the sheet is formed and held by means of a shaping element which remains associated with the cover after production; advantageously, such a shaping element is in the form of a set of cups which can be nested one inside the other and between which the central zone of the plane sheet constituting the receptacle as well as the base of the radiating strips is held captive; in such a case, the bottom of the cup of small cross-section comprises a weakened zone which possibly allows the user to make the receptacle non-leaktight.

According to a variant, it may be envisaged to hold the folded-up sheet by providing an adhesive substance either in the bottom of the shaping element (cup) or on the surface of the sheet.

According to another variant, the plane sheet is shaped and held in shape by thermoforming the said sheet, performed either directly at the user's premises or possibly at the factory (in the latter case, it is obvious that the advantage of flat storage before use is lost).

Finally, production may be envisaged of a receptacle in accordance with the invention which not only surrounds the pot over its entire height, but also surrounds the plant which the said pot contains, the said receptacle therefore being able to be used as a receptacle during transport between the sales site and the place of use and then as a simple cover or receptacle after the radiating strips have been cut off over a part of their height.

BRIEF DESCRIPTION OF THE DRAWINGS

The invention and the advantages which it brings will, however, be better understood by virtue of the embodiment example given hereafter by way of example, but in no way limiting, and which is illustrated by the appended diagrams in which.

DETAILED DESCRIPTION OF A PREFERRED EMBODIMENT

Figure 1:
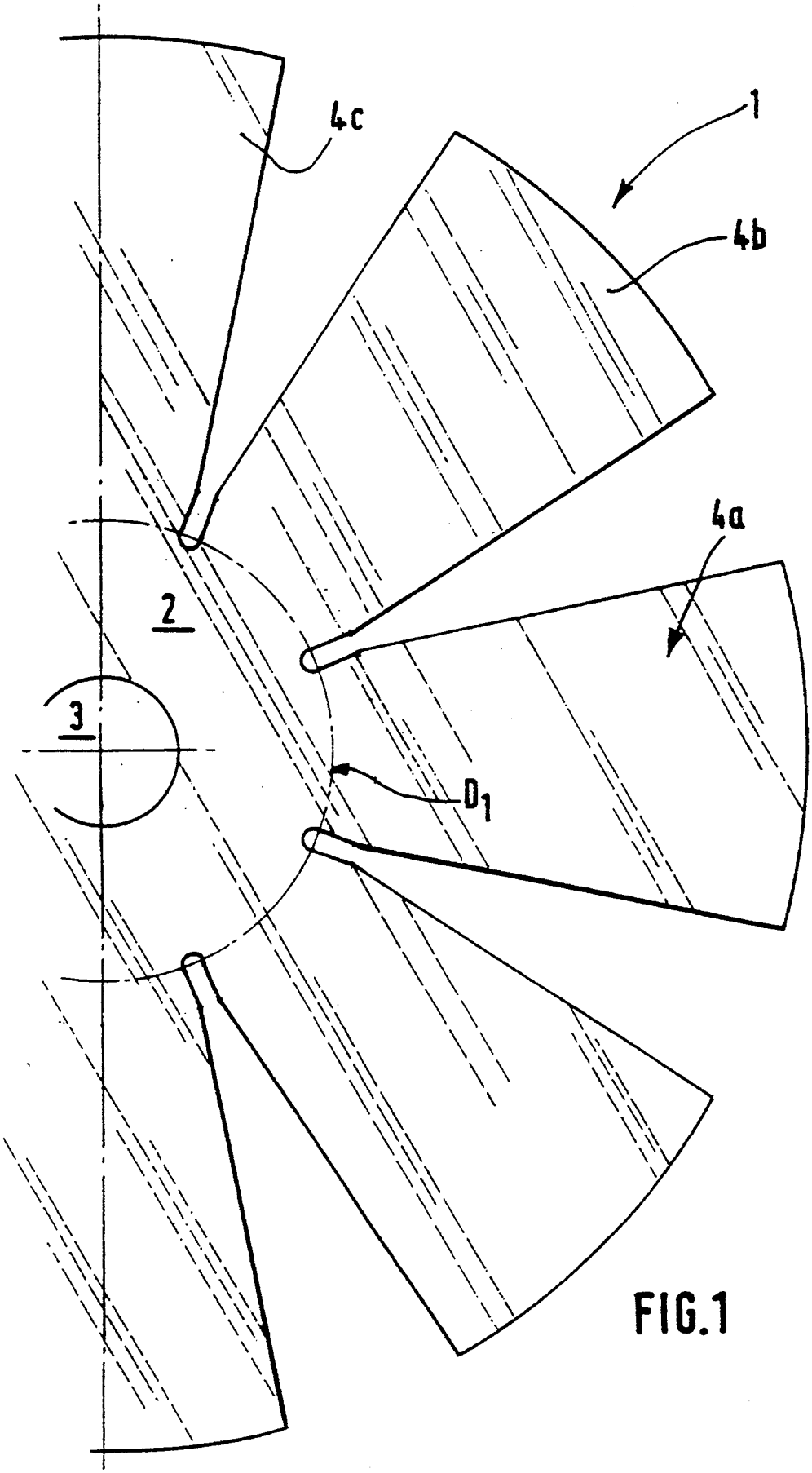
FIG. 1 illustrates, in a plan view, half of a plane sheet allowing a receptacle in accordance with the invention to be produced, intended more particularly for forming a cover for pot plants.
Figure 2:
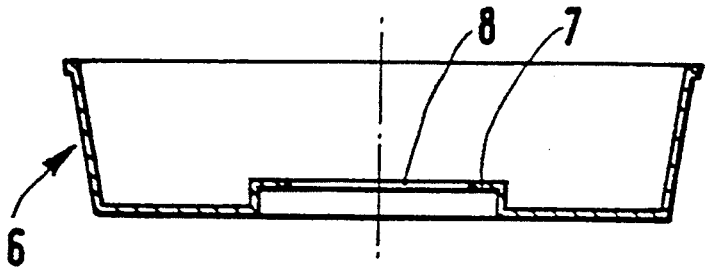
FIG. 2 and FIGS. 3*a*, 3*b*, 3*c* illustrate an embodiment of a means allowing the sheet illustrated in FIG. 1 to be formed so as to obtain the said pot cover.

If reference is made to the appended diagrams, a plane sheet such is represented in FIG. 1 and which is in the form of a precut blank is essentially used to produce a receptacle in accordance with the invention and which makes it possible, in the illustrative embodiment given, to display, decorate and protect pots intended to receive plants or flowers. Such a plane sheet, designated by the general reference (1) comprises a circular central zone (2), whose diameter D1 determines the maximum diameter of the pot which it can contain, any pot of smaller diameter of course being able to be arranged inside such a cover. This central zone has, in the embodiment illustrated in FIG. 1, an opening (3). From this central zone (1) there extend a plurality of radiating strips (4*a*, 4*b*, etc.) separated from one another and whose total surface area is at least equal to the developed surface area of the volume which is to surround the pot of the plant to be displayed.

The substance from which such a sheet (1) is produced may be of any type, but will preferably be chosen from among materials such as card, polyethylene (PE), polypropylene (PP), polyvinyl chloride (PVC), polyethylene terephthalate (PET). The sheet (1) may be transparent or coloured and possibly printed with a predetermined motif.

Such a sheet however, so as to allow production of a receptacle or cover in accordance with the invention, must have a thickness and physical strength such that the radiating strips (4*a*, 4*b*, etc.) cannot deform under their own weight, especially when they are arranged vertically or substantially vertically. In order to improve the physical strength of the sheet, it may be envisaged to provide, over the length of the radiating strips (4*a*, 4*b*, etc.), reinforcement zones formed, for example, by "ribs" obtained directly during folding.

The forming of the receptacle in accordance with the invention may be obtained by compressing the aforementioned sheet in its central part. Such a compression operation leads to the lifting up of the radiating strips (4*a*,4*b*) which come next to each other edge to edge (possibly with partial overlap), the folded strips and the flat bottom being held in this position. Various solutions may be envisaged for producing such a shape.

According to an embodiment illustrated by FIGS. 2 to 4*e*, the forming and holding of the sheet (1) are obtained by means of an assembly essentially comprising two cups, designated by the general references (5) and (6), one (5) , (FIG. 2) being able to be nested in the second (6) (FIGS. 3*a* to 3*c*), by trapping between them the circular base (2) of the sheet and part of the height of the precut zones neighbouring the diameter D1 in FIG. 1.

Figure 3A:
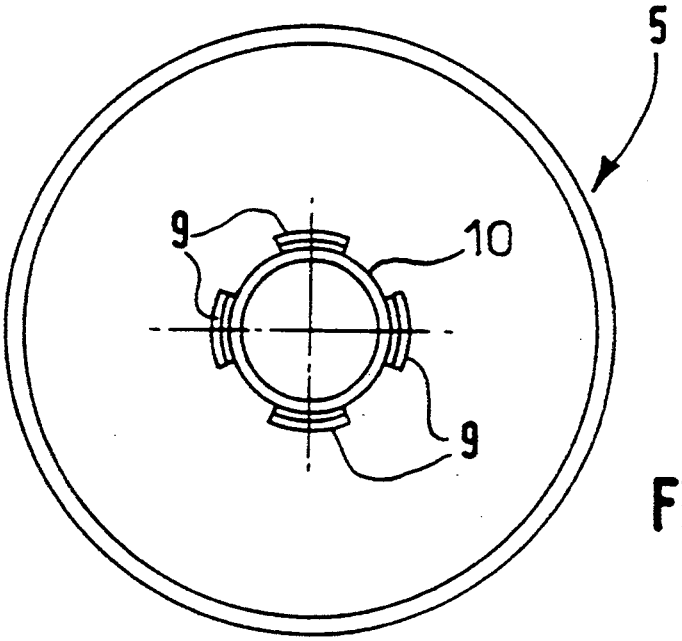
Figure 3B:
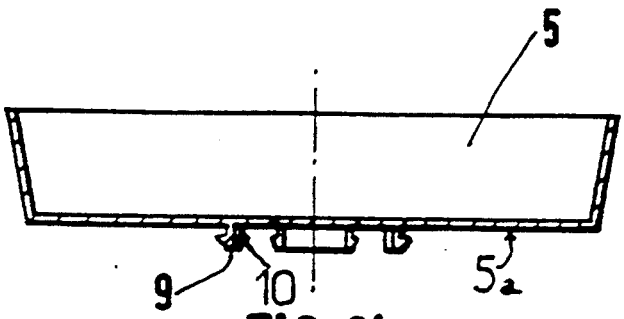
Figure 3C:
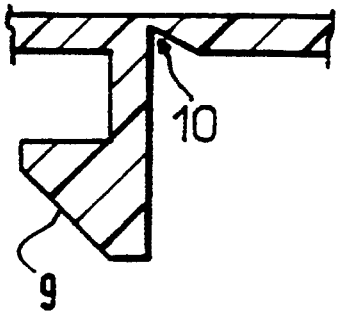
Figure 4A:
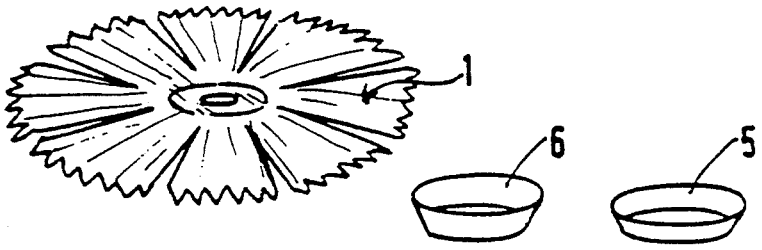
FIGS. 4*a* to 4*e* illustrate, diagrammatically, the manner in which a receptacle in accordance with the invention is produced from the elements illustrated in FIGS. 1, 2 and 3*a*, 3*b*, 3*c*.
Figure 4B:
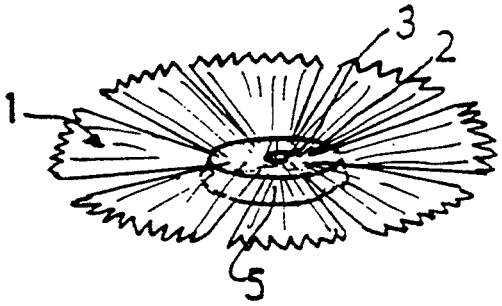
Figure 4C:
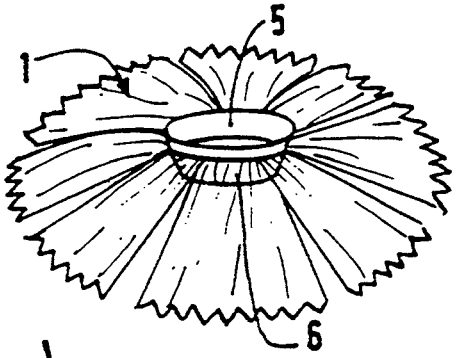
Figure 4D:
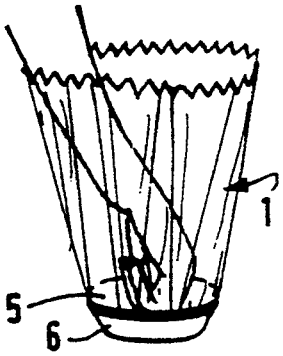
Figure 4E:
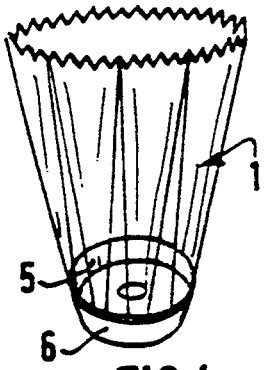

Various types of means may be envisaged for locking the cup (5) inside the outer cup (6). In the embodiment illustrated in FIGS. 2 to 3*c*, locking is obtained by means of a clipping system which allows, during shaping of the sheet (1), the latter also to be held on the cup (5) so as to facilitate its manipulation and allow its centring. In the embodiment illustrated, the inner cup (5) comprises, at its base, (see FIGS. 3*a* and 3*b*) four equidistant sectors (9) forming clips and which, when the said cup (5) is combined with the outer cup (6), make it possible to ensure the linking together of the two cups. FIG. 3*c* is an enlarged view showing the structure of such sectors (9), a structure such that they can be introduced by force inside an opening (8) provided in the central part of the outer cup (6). Moreover, in this embodiment, the inner cup (5) advantageously comprises, in its central part, a weakened zone (10) which allows the user to obtain a cover which is non-leaktight allowing outflow of the moistening water.

FIGS. 4*a* to 4*e* illustrate the manner in which such a receptacle is produced from a set of elements comprising a sheet (1) and two cups (5,6), these elements being represented side by side in FIG. 1.

In a first instance (FIG. 4*b*), the user arranges the precut sheet (1) around the cup (5) so that it comes to press against the base (5*a*) of the said cup (see FIG. 3*b*), which makes it possible to hold the said sheet by virtue of the presence of the clips (9) which pass through the central open zone (3) of the sheet (1). This positioning of the sheet (1) on the cup (5) being performed, the user brings the assembly (cup (5)+sheet (1)) above the concave part of the second cup (6) (see FIG. 4*c*). The trapping of the circular bottom (2) of the sheet (1) by the user leads to the standing up of the lateral strips (4*a*,4*b*, etc.), this operation being able to be produced either by action of the user on the bottom of the cup (5) as shown in FIG. 4, or possibly by directly placing the pot inside the cover thus formed. The user brings about locking of the two cups (5,6) one inside the other, so as to ensure that the sheet (1) thus formed (see FIG. 4*e*) is held in position.

Since the two cups (5,6) are nested one inside the other, a receptacle is obtained having the form of a pot cover, the precut lateral strips being held substantially vertically, edge to edge or possibly with a slight overlap. Although :such a receptacle or cover may be used as it is, it may be envisaged to securely fasten the edges of the precut strips (4*a*,4*b*, etc.) together, for example by stapling or adding a peripheral link.

Of course, the invention is not limited to the illustrative embodiment described previously, but covers all the variants thereof imagined in the same spirit. Thus, it could be envisaged to use a single cup (6) as the element for shaping and holding the plane sheet (1), the folded-up sheet thus being held for example by providing an adhesive substance in the bottom of the cup (6) or on the surface of the sheet (1).

Production might also be envisaged of such a cover without the addition of cups or additional holding means, for example by shaping the sheet by a thermoforming operation during which the lateral strips (4*a*,4*b*) are stood up and the receptacle produced is held in this shape.

Finally, as previously explained, production might be envisaged. of receptacles in accordance with the invention having a base which is other than circular, for example receptacles having a rectangular base and able to be used in other fields such as, for example, for displaying objects (food, etc.).

We claim:

1. An apparatus used in displaying, decorating and protecting an article such as a pot containing a plant, said apparatus comprising:

a precut sheet having a central element of predetermined dimensions and elongated strips each being of a predetermined length and radiating outwardly from said central element, said elongated strips spaced apart about the periphery of said central element and formed from a material that will retain its shape when oriented substantially vertically;

a container for receiving therein said central element of said sheet said container having a base and a raised side wall, said side wall being substantially shorter than the length of said elongated strips;

retaining means insertable within said container for holding said central element of the sheet against said base of said container and forcing the strips against the side wall of said container to support the strips in a raised position; and locking means for securing said container to said retaining means, said locking means including clips formed on said retaining means that snap into an opening formed within the base of said container, said central element of said precut sheet having a hole allowing said clips to pass therethrough wherein a receptacle for housing an article such as a pot containing a plant is created.

2. The apparatus of claim 1 wherein the adjacent edges of the strips come together when the strips are brought to a raised condition to establish an enclosed receptacle.

3. The apparatus of claim 10 wherein said sheet is formed of a material selected from the group consisting of paper stock, polyethylene, polypropylene, polyvinyl chlodide, and polyethylene terephthalate.

4. The apparatus of claim 1 wherein the central element of the sheet is circular and the space between adjacent strips diverges outwardly therefrom.

5. The apparatus of claim 4 wherein said container is a circular cup and said retaining means is a cylindrical member that is capable of being nested in said cup.

6. The apparatus of claim 1 wherein said container includes a weakened section in said base of the container whereby the weakened section can be removed to provide a drain in said container.

7. The apparatus of claim 1 wherein said sheet is a thermoformable material and said strips are held in a predetermined raised condition by heating the sheet.

8. The apparatus of claim 1 wherein said article is a pot that is seated upon the central element inside he container, said pot containing a plant and wherein said strips have a radial length such that the strips encompass the plant when brought to a predetermined raised condition to protect said plant.

9. The apparatus of claim 8 wherein said strips are severable to permit the strips to be cut to a desired length.

10. The apparatus of claim 8 wherein the sheet contains a decorative pattern thereon.

11. The apparatus of claim 8 wherein said sheet is transparent.

* * * * *